US007037152B2

(12) United States Patent
Sasayama et al.

(10) Patent No.: US 7,037,152 B2
(45) Date of Patent: May 2, 2006

(54) STEERING APPARATUS FOR AN OUTBOARD MARINE ENGINE

(75) Inventors: Katsuhiko Sasayama, Kobe (JP); Kenichi Shimada, Kobe (JP); Katsuhiko Arakawa, Kobe (JP)

(73) Assignees: Marol Co., Ltd., Kobe (JP); Y'S Gear Co., Ltd., Shizuoka (JP)

( * ) Notice: Subject to any disclaimer, the term of this patent is extended or adjusted under 35 U.S.C. 154(b) by 97 days.

(21) Appl. No.: 10/924,765

(22) Filed: Aug. 25, 2004

(65) Prior Publication Data

US 2005/0221696 A1 Oct. 6, 2005

(30) Foreign Application Priority Data

Apr. 5, 2004 (JP) ..... 2004-110764

(51) Int. Cl.
*B63H 21/26* (2006.01)

(52) U.S. Cl. ..... 440/615; 440/53

(58) Field of Classification Search ..... 440/61 S, 440/61 C, 53; 114/144 R
See application file for complete search history.

(56) References Cited

U.S. PATENT DOCUMENTS 4,373,920 A 2/1983 Hall et al.
5,002,510 A * 3/1991 Rump ..... 440/61 R
5,997,370 A 12/1999 Fetchko et al.

FOREIGN PATENT DOCUMENTS

JP 3-33559 3/1991

* cited by examiner

*Primary Examiner*—Ed Swinehart
(74) *Attorney, Agent, or Firm*—Wenderoth, Lind & Ponack, L.L.P.

(57) ABSTRACT

A tilt tube 21 extends along a horizontal tilt axis B. A steering hydraulic cylinder 8 slides along a piston rod 7, which extends in parallel with the tilt axis B. An eccentric link shaft 6 is positioned between the tilt tube 21 and piston rod 7 and extends in parallel with the tilt axis B. A pair of linking means 4 supports the tilt tube 21, link shaft 6 and piston rod 7. The distance L0 between the tilt tube 21 and piston rod 7 is shorter than the sum of the distance L1 between the tilt tube 21 and the link shaft 6 and the distance L2 between the link shaft 6 and the piston rod 7.

7 Claims, 7 Drawing Sheets

STEERING APPARATUS FOR AN OUTBOARD MARINE ENGINE

FIELD OF THE INVENTION

The present invention relates to an outboard marine engine which can be mounted on the (transom) stern of the hull of a fishing boat, a motorboat, a yacht or another boat. In particular, the invention relates to a steering apparatus easy to fit to any type of clamp bracket fixed to the boat hull on which an outboard marine engine is mounted.

BACKGROUND OF THE INVENTION

A conventional outboard marine engine of this type is supported by an engine bracket, which is supported pivotably on a tilt tube (a through tube). The tilt tube extends along a horizontal tilt axis, around which the outboard marine engine can tilt. The tilt tube extends through a clamp bracket, which is fixed to a boat hull. The outboard marine engine can turn around a steering axis, which is roughly perpendicular to the engine bracket, to steer the boat. In general, the boat can be steered either hydraulically with a hydraulic cylinder or mechanically with push-pull cables by turning the steering handle.

A boat fitted with an outboard marine engine of relatively low horsepower can be steered mechanically with push-pull cables. A boat fitted with an outboard marine engine of high horsepower can be steered with a hydraulic cylinder, which slides along a horizontal piston rod. Both ends of the piston rod are supported by a pair of arms, which is supported by both ends of a horizontal tilt tube.

For example, Japanese Examined Patent Publication No. H3-33559 (pages 1–6 and FIG. 2) discloses an outboard marine engine, which is connected to a hydraulic cylinder by a steering lever. The hydraulic cylinder can slide along a piston rod, both ends of which are supported by a pair of arms. The arms are supported pivotably by both ends of a tilt tube.

There are various types of clamp brackets which can be fitted on boat hulls. The clamp brackets are classified mainly as detachable brackets suitable for boats and fixed brackets, which can be screwed in advance to boat hulls.

Each of the detachable brackets includes a hook, which extends downward and is fitted with a clamp.

When an outboard marine engine which can be turned by a hydraulic cylinder tilts upward up to 75 degrees, the parts supporting the cylinder may interfere with the clamp bracket supporting the engine, depending on the bracket type. Therefore, there are demands for a hydraulic cylinder type steering apparatus which can be fitted to any type of clamp bracket, and which can tilt up to the maximum of 75 degrees.

The hydraulic cylinder can slide along a piston rod, which is supported by a pair of arms. The arms are supported by both ends of a tilt tube, which extends along the tilt axis. Both ends of the tilt tube have threads cut outside them. Different tilt tubes may have end threads of different sizes.

When the hydraulic cylinder slides along the piston rod, the steering angles on both sides may differ depending on the initial position of the cylinder, and/or on how the cylinder is connected to a steering lever, which connects it to the outboard marine engine. This makes it difficult to steer the boat to a maximum of 35 degrees equally on each side.

SUMMARY OF THE INVENTION

The object of the present invention is to provide a hydraulic steering apparatus that can be fitted to any type of clamp bracket fixed to the boat hull on which an outboard marine engine is mounted, and that can tilt to the maximum without interfering with the bracket and steer the boat to the maximum equally on each side.

A steering apparatus according to the present invention is supported by a bracket fixed to the stern of a hull, on which an outboard marine engine is mounted. The steering apparatus can turn the engine to the limit in opposite directions on a substantially vertical axis. The steering apparatus can tilt on a substantially horizontal tilt axis. The steering apparatus includes a tilt tube extending along the tilt axis and supported by the bracket. First and second linking means are supported by both ends of the tilt tube pivotably around the tube. The linking means support both ends of a piston rod and both ends of an eccentric link shaft. A steering hydraulic cylinder is supported by the piston rod slidably along it. The eccentric link shaft is positioned between the tilt tube and the piston rod and higher than the tilt tube. The distance between the tilt tube and the piston rod is shorter than the sum of the distance between the tilt tube and the eccentric link shaft and the distance between the eccentric link shaft and the piston rod.

The foregoing connection of the tilt tube and the piston rod through the eccentric link shaft absorbs the displacement of the steering hydraulic cylinder which is longitudinal of the boat when the outboard engine is turned right and left to steer the boat. This connection enables the linking means to be so shaped as to avoid interfering with the bracket, whether detachable or fixed, when the engine tilts.

The piston rod may be longer than the eccentric link shaft. Each of the linking means may include a first arm and a second arm. The first arm links the tilt tube and the eccentric link shaft together. The second arm links the eccentric link shaft and the piston rod together. The second arm supports the adjacent ends of the eccentric link shaft and piston rod at two points spaced axially from each other. The second arm has an arm length enabling it to support the longer piston rod. The two arms are connected together pivotably with respect to each other around the eccentric link shaft.

The piston rod having a cylinder stroke long enough to achieve the necessary steering angle can be positioned between the two arms of each linking means. The arms do not interfere with the bracket when the engine tilts.

Each of the linking means may include a body and an arm. The body has a cylindrical cavity formed in it. The arm is spaced from the body axially of the cylindrical cavity and supports the adjacent end of the piston rod. A bush is fitted in the cylindrical cavity. An eccentric cam is supported rotatably inside the bush. The eccentric link shaft extends through the center of the eccentric cam. The tilt tube extends rotatably through the eccentric cam and is spaced from the eccentric link shaft.

In this case, each of the linking means is a single unit, which can support the piston rod having a cylinder stroke long enough to achieve the necessary steering angle. This unit does not interfere with the bracket when the marine engine tilts.

At least the first linking means may have a hole cut through it near its one end. The steering apparatus may further include an end fitting, which includes a substantially cylindrical body. This body integrally includes a front portion, a flange and a barrel. The front portion can be inserted loosely into the tilt tube when the first linking means is fitted to the tube. The front portion has a conical surface converging forward. The flange is formed between the front portion and the barrel and can contact with an end face of the tilt tube. The barrel extends through the hole of the first linking means. The cylindrical body has a thread cut inside it. A threaded rod extends through the cylindrical body, engages with the thread of this body and can engage at its rear end with a rotating tool. A taper sleeve is fixed to the front end of the threaded rod, can be inserted loosely into the tilt tube and has a conical surface converging backward. A first ring spring surrounds the conical surface of the cylindrical body. A second ring spring surrounds the conical surface of the taper sleeve. A cylindrical sleeve is interposed between the two ring springs. A nut engages with the rear end of the threaded rod so as to fix the first linking means between the nut and the flange.

It is possible to fit the end fitting inside the tilt tube by taking advantage of the inner diameter of tilt tubes which is common to all makers. This makes it possible to fit the linking means to the tilt tube for an outboard marine engine made by any maker. This also makes it easy to position the steering hydraulic cylinder centrally by centering the cylinder.

The nut may be resinous. A washer may be interposed between the resinous nut and the first linking means. Even if the resinous nut is tightened excessively, it does not damage the linking means etc. Even if different linking means vary in width, it is possible to fix any of them by adjusting the number of washers.

DETAILED DESCRIPTION OF THE PREFERRED EMBODIMENTS

Preferred embodiments of the present invention will be described below in detail with reference to FIGS. 1–7.

Figure 1:
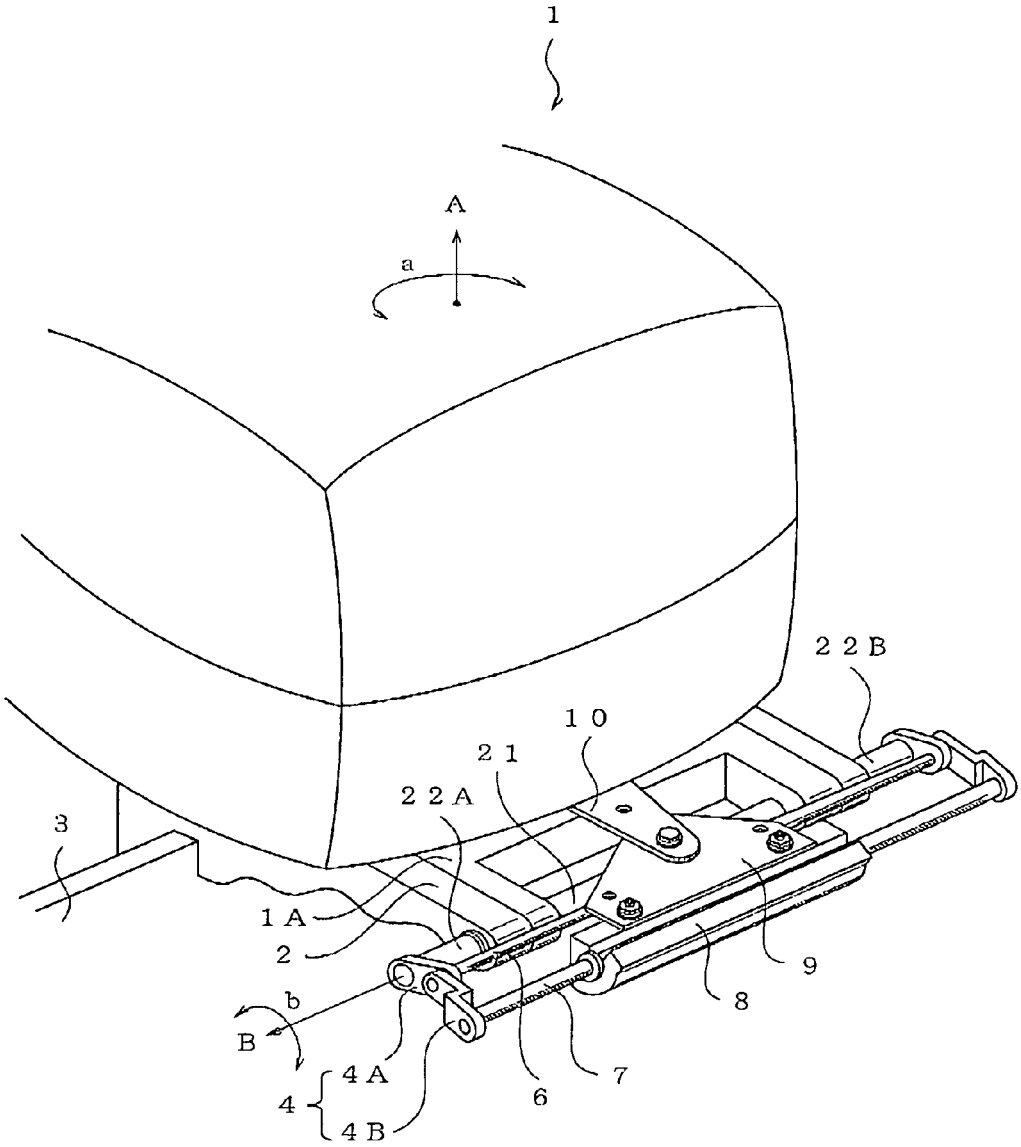
FIG. 1 is a schematic perspective view of the stern of a boat, on which is mounted an outboard marine engine fitted with a steering apparatus embodying the present invention.

With reference to FIG. 1, an outboard marine engine 1 is supported by an engine bracket 1A, which is supported pivotably on a tilt tube (or through tube) 21. The tilt tube 21 extends along a horizontal tilt axis B through a hull bracket 2, which is fixed to the stern of the hull 3 of a boat. Accordingly, the engine 1 can tilt in opposite directions "b" around the tilt axis B. The boat can be steered by turning the engine 1 in opposite directions "a" on a steering axis A, which is roughly perpendicular to the engine bracket 1A.

Both ends of the tilt tube 21 are fitted with end fittings 22A and 22B, each of which is connected with one end of a linking means 4. A piston rod 7 extends between the other ends of the two linking means 4 at both ends of the tilt tube 21. The piston rod 7 supports a steering hydraulic cylinder 8, which can slide along it. An eccentric link shaft 6 is positioned between the tilt tube 21 and piston rod 7. The two linking means 4 support the tilt tube 21, link shaft 6 and piston rod 7 in parallel with the tilt axis B.

The bottom of the engine 1 is fitted with a steering lever 10, which is connected to a connecting plate 9. The connecting plate 9 is bolted to the hydraulic cylinder 8, which slides along the piston rod 7 to turn the engine 1 on the steering axis A.

Figure 2:
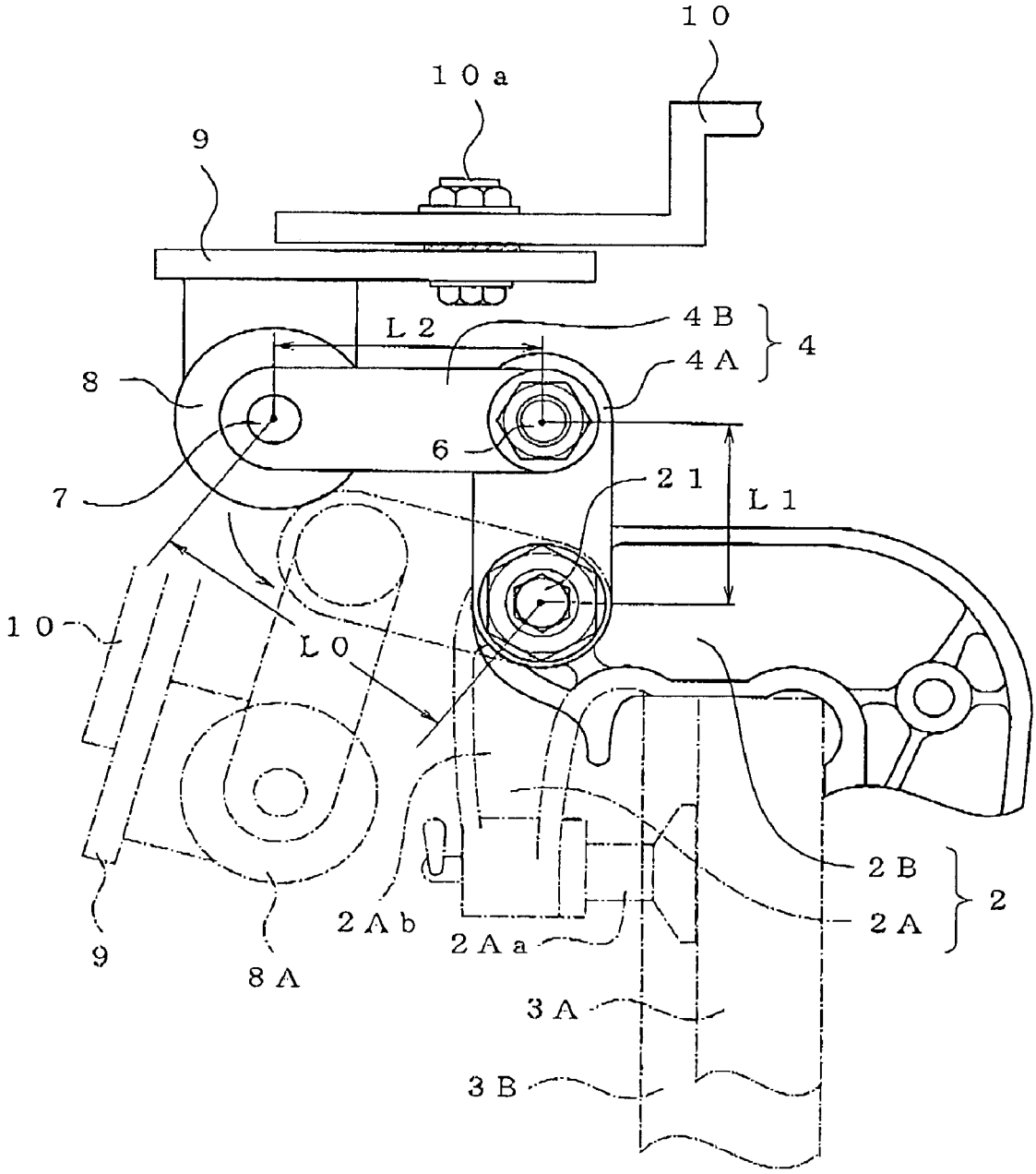
FIG. 2 is a partial side view of the steering apparatus.
Figure 3:
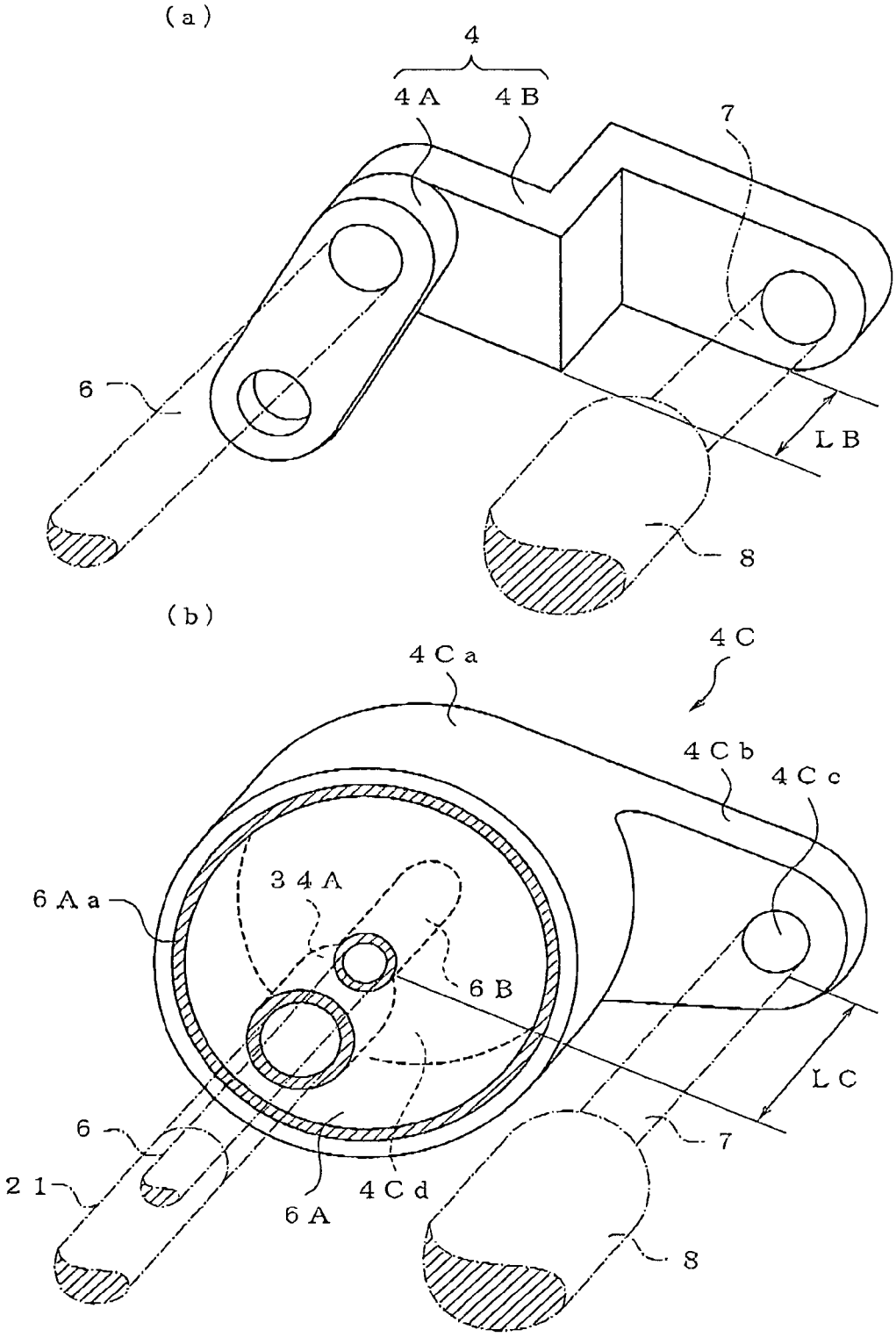
FIG. 3*a* is a perspective view of one of the linking means of the steering apparatus.
FIG. 3*b* is a perspective view of a linking means which may replace that shown in FIGS. 2 and 3*a*.
Figure 4:
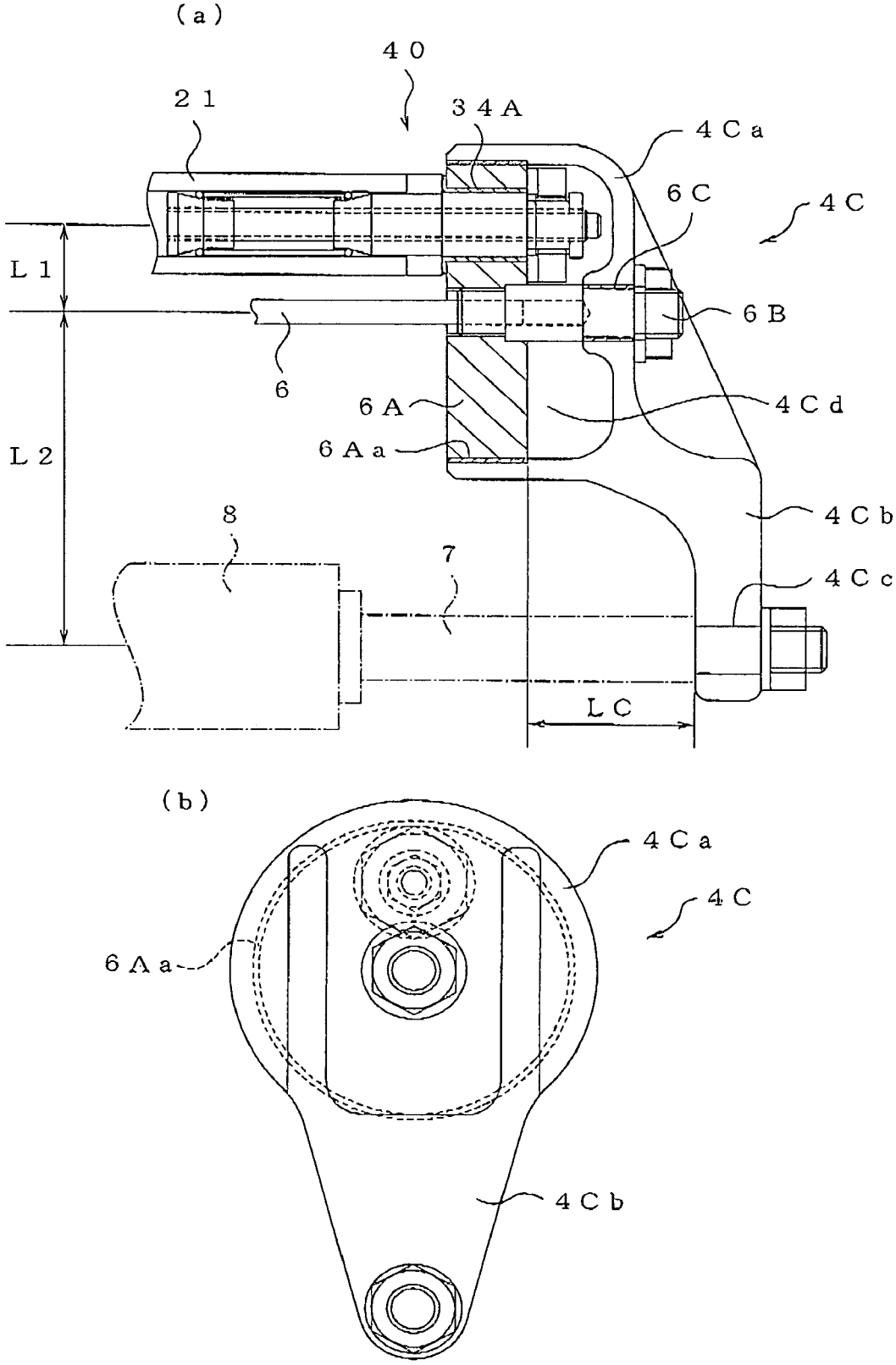
FIG. 4*a* is a radial section of the linking means shown in FIG. 3*b*.
FIG. 4*b* is an end view of the linking means shown in FIGS. 3*b* and 4*a*.

FIG. 2 shows a steering apparatus, which is fitted to the hull bracket 2. The hull bracket 2 may be either a detachable bracket 2A or a fixed bracket 2B. The detachable bracket 2A is suitable for a relatively small hull 3A. This bracket 2A includes a downward extension 2Ab, which is fitted with a clamp 2Aa for clamping the bracket to the hull 3A. The fixed bracket 2B is screwed in advance to a relatively large hull 3B.

The engine 1 can tilt up to a maximum of 75 degrees around the tilt axis B when the boat is landed, or when the engine 1 is raised completely out of the water. The engine 1 tilts together with the linking means 4, hydraulic cylinder 8, steering lever 10, etc. around the tilt axis B.

The eccentric link shaft 6 is positioned between the tilt tube 21 and piston rod 7. The two linking means 4 support the tilt tube 21, eccentric link shaft 6 and piston rod 7. The distance between the tilt tube 21 and piston rod 7 is shorter than the sum of the distance between the tube 21 and eccentric link shaft 6 and the distance between the eccentric link shaft 6 and rod 7. Accordingly, when the engine 1 tilts upward, the linking means 4, hydraulic cylinder 8, etc. do not interfere with the hull bracket 2.

With reference to FIGS. 1, 2 and 3*a*, each linking means 4 consists of a first arm 4A and a second arm 4B. The first arms 4A of the two linking means 4 connect the tilt tube 21 and eccentric link shaft 6. The second arms 41 of the two linking means 4 connect the link shaft 6 and piston rod 7.

With reference to FIG. 2, the distance L0 between the tilt tube 21 and piston rod 7 is shorter than the sum of the distance L1 between the tube 21 and eccentric link shaft 6 and the distance L2 between the shaft 6 and rod 7. Accordingly, the arms 4A and 4B of each linking means 4 form an angle with each other. The eccentric link shaft 6 is higher than the tilt tube 21. Consequently, even when the engine 1 tilts up to the maximum of 75 degrees, with the arms 4A and 4B, eccentric link shaft 6 and piston rod 7 shifting to the positions represented by alternate long and short dash lines in FIG. 2, the arms 4A and 4B, hydraulic cylinder 8A, etc. do not interfere with the hull bracket 2 (2A or 2B).

As stated above, the arms 4A and 4B of each linking means 4 form an angle with each other. Accordingly, when the hydraulic cylinder 8 slides laterally of the boat, turning the steering lever 10 on the steering axis A, the two linking means 4 absorb the displacement of the hydraulic cylinder 8 which is longitudinal of the boat. This makes it possible to tilt the engine 1 to the maximum, with the boat steered at any angle, without affecting the tilting angle of the engine 1.

Figure 5:
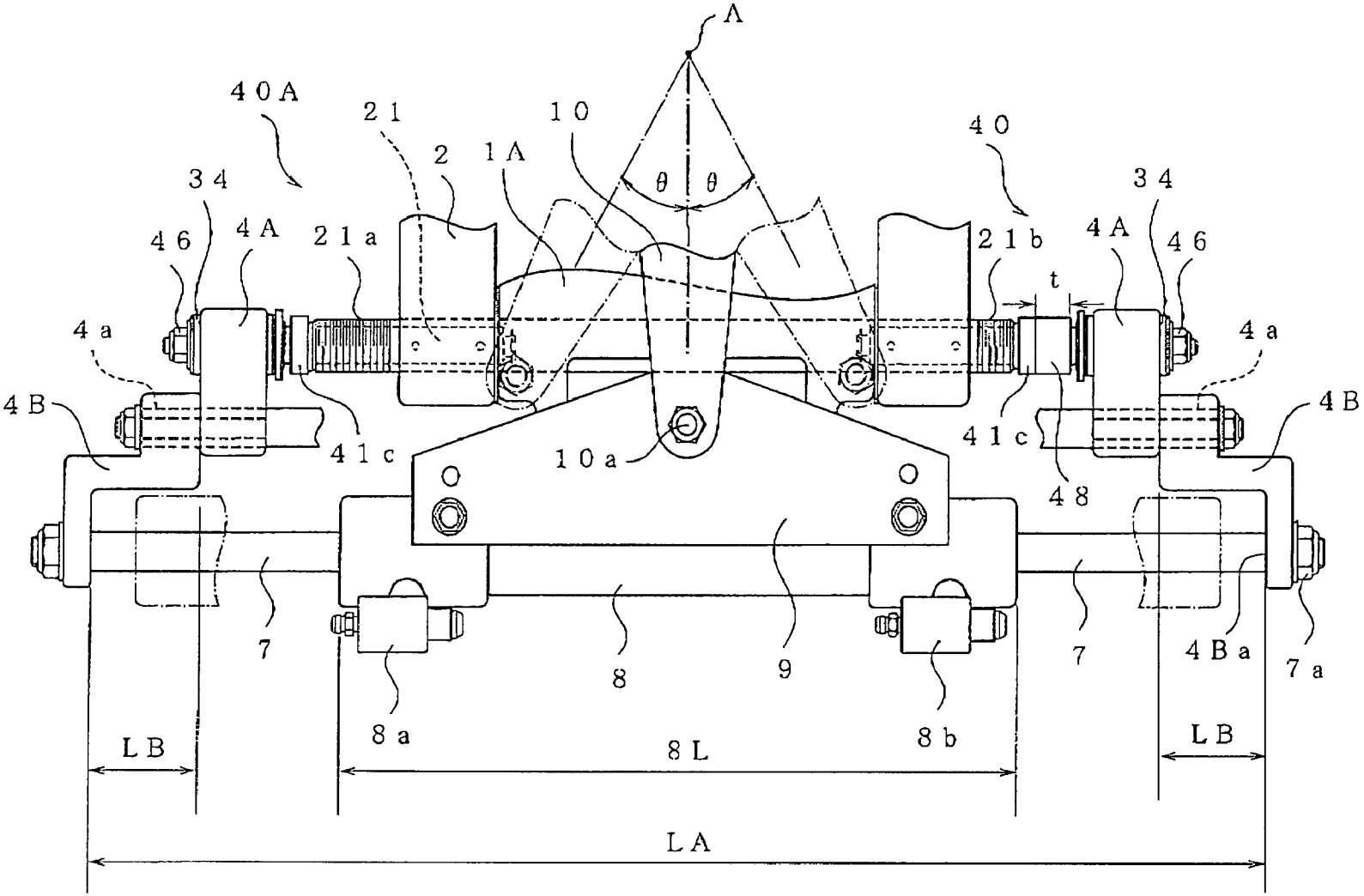
FIG. 5 is a top plan of a steering apparatus embodying the present invention.
Figure 6:
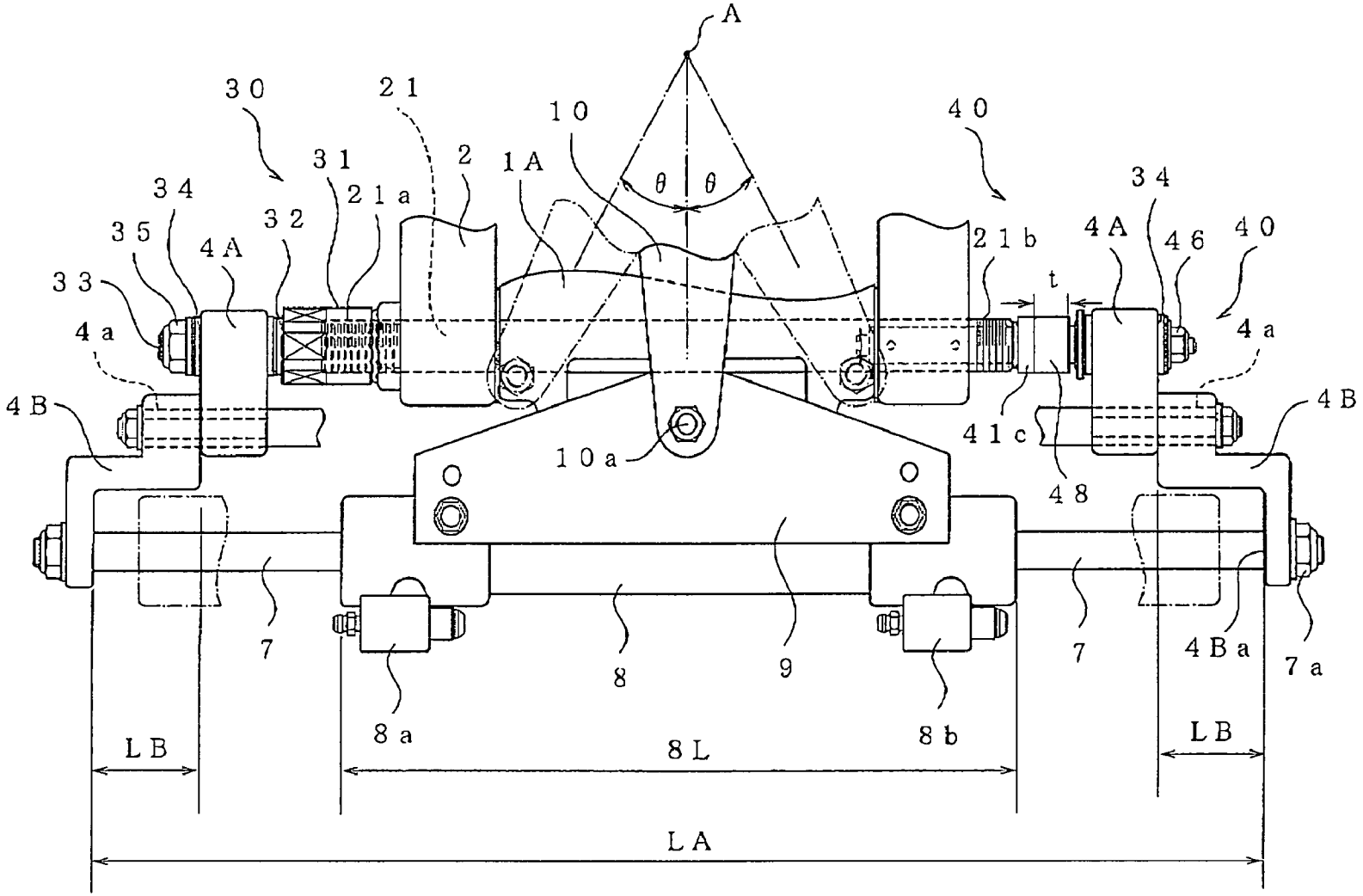
FIG. 6 is a top plan of another steering apparatus embodying the present invention.
Figure 7:
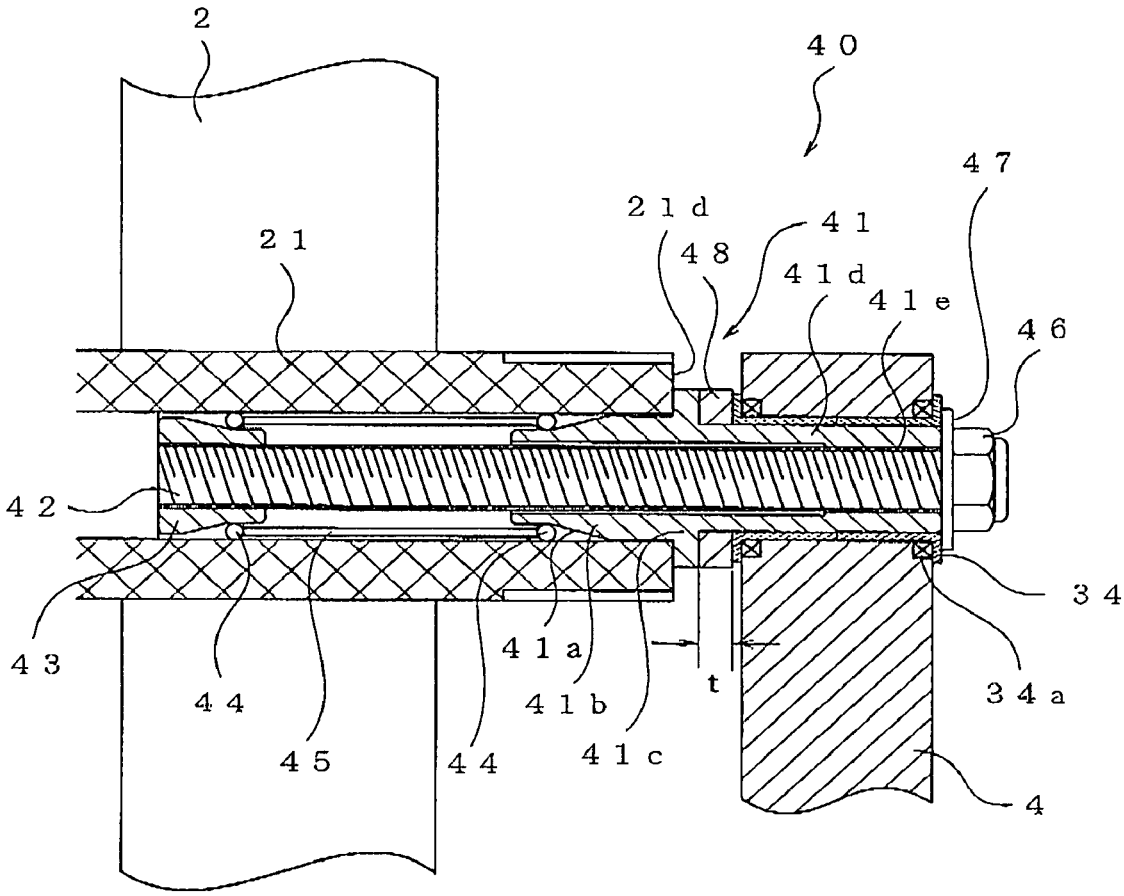
FIG. 7 is an enlarged partial section of a steering apparatus embodying the present invention.

FIGS. 5–7 show how the linking means 4 are fitted to the tilt tube 21. FIGS. 5–7 also show a conventional end fitting 30, which can be fitted to a rated thread, and end fittings 40 according to the present invention.

With reference to FIG. 6, the tilt tube 21 includes a rated threaded portion 21*a* (⅞ inch) formed at its right (left in FIG. 6) end. The end fitting 30 includes a tubular nut 31 and a shaft 32, which are integral and coaxial with each other.

The nut 31 engages with the threaded portion 21*a*. The shaft 32 includes a threaded portion 33 formed at its outer end. This threaded portion 33 is surrounded by a bush 34, which is fixed to the end fitting 30 by a nut 35. The adjacent linking means 4 is fitted around the bush 34, with bearing means 34*a* (FIG. 7) interposed between them, so that the linking means 4 can pivot around the tilt tube 21.

The tilt tube 21 includes a ⅞-inch threaded portion, an M20 threaded portion or another threaded portion 21*b* formed at its other end. Different makers make tilt tubes with threads differing in size, but all the tubes have an inner diameter of 16 mm. Therefore, in this embodiment, an end fitting 40 is fitted inside the tilt tube 21.

With reference to FIG. 5, description is provided of how the tilt tube 21 is fitted with the linking means 4. In FIG. 5, the left (right in FIG. 5) end of the tilt tube 21 is fitted with an end fitting 40 including a spacer 48, and the other end is fitted with an end fitting 40A including no spacer.

As shown in detail in FIG. 7, the end fitting 40 includes a fitting body 41, a threaded rod 42, a taper sleeve 43, two ring springs 44, a cylindrical sleeve 45 and a nut 46. The fitting body 41 is roughly cylindrical and includes a front portion 41*b*, a flange 41*c* and a barrel 41*d*. The front portion 41*b* includes a taper portion 41*a* and can be inserted loosely into the adjacent end of the tilt tube 21. The flange 41*c* is formed between the front portion 41*b* and barrel 41*d*, and can be in contact with the adjacent end face 21d of the tilt tube 21. The barrel 41*d* is surrounded by a bush 34, which is fixed to the fitting body 41 by a nut 46, with a washer 47 interposed between the bush and nut. The spacer 48 is interposed between the flange 41*c* and bush 34. The first arm 4A of the adjacent linking means 4 is fitted around the bush 34, with bearing means 34*a* interposed between them, so that the linking means 4 can pivot around the fitting body 41.

The first arm 4A has a hole formed through its end portion opposite its end connected to the associated second arm 4B. The barrel 41*d* of the fitting body 41 is put into the hole of the first arm 4A, with the bush 34 interposed between them. The bush 34 is fixed to the barrel 41*d* by the nut 46, with the washer 47 interposed between them. The nut 46 is resinous, so that it does not damage the first arm 4A etc. even if it is tightened up. Even if different linking means vary in width, it is possible to fix any of them by adjusting the number of washers.

The barrel 41*d* of the fitting body 41 has a thread 41*e* cut inside it. The thread 41*e* engages with the threaded rod 42. The taper sleeve 43 engages with the inner end of the threaded rod 42. The cylindrical sleeve 45 is interposed between the taper sleeve 43 and fitting body 41 around the threaded rod 42. After the taper sleeve 43 engages with the threaded rod 42, the rear end of the sleeve 43 is bonded, caulked or otherwise fixed to the rod 42.

The conical surface of the taper portion 41*a* of the fitting body 41 is surrounded by one of the ring springs 44. The conical surface of the taper sleeve 43 is surrounded by the other ring spring 44. The cylindrical sleeve 45 is interposed between the two ring springs 44. The ring springs 44 can, in their normal states, be put into the tilt tube 21 and have unground sandy surfaces covered with black rust. The taper sleeve 43 and cylindrical sleeve 45 as well can be put into the tilt tube 21. After the threaded rod 42 is fitted with the other parts of the end fitting 40, this fitting is inserted into the adjacent end of the tilt tube 21 until the flange 41*c* comes into contact with the end face 21*d* of the tube 21. Subsequently, the threaded rod 42 is rotated, moving the taper sleeve 43 toward the fitting body 41. Consequently, the conical surfaces of the taper portion 41*a* of the fitting body 41 and the taper sleeve 43 expand the ring springs 44, bringing the sandy spring surfaces into compressive contact with the inner peripheral surface of the tilt tube 21 so that the body 41 can be fixed to the tube 21.

The threaded rod 42 may have a hexagonal hole (not shown) formed in its outer end face for engaging with a wrench or another rotating tool, with which the rod 42 can be rotated. Of course, the threaded rod 42 may be rotated otherwise. The threaded rod 42 is threaded over its whole length, but might be threaded only at both its end.

The fitting body 41, threaded rod 42, taper sleeve 43, etc. are made of stainless steel, but might be made of other material.

With reference to FIG. 6, the conventional end fitting 30 may engage with the rated threaded portion 21*a* of the tilt tube 21. One of the end fittings 40 according to the present invention may be fitted to the end of the tilt tube 21, where the threaded portion 21*b* is located. The linking means 4 are supported pivotably by the end fitting 30 and 40. Even in this case, it is possible to center the steering hydraulic cylinder 8 for various outboard engines by adjusting the arm length LB of the second arms 4B of the linking means 4 and the width "t" of the spacer 48.

The arms 4A and 4B of each linking means 4 are connected pivotably with respect to each other by the eccentric link shaft 6, with a bearing, a bush or another means 4*a* fitted around the shaft 6. The other end of the second arm 4B has a hole 4Ba formed through it. The piston rod 7 extends through the holes 4Ba of the second arms 4B of the two linking means 4. Nuts 7*a* engage with both ends of the piston rod 7 and are tightened to fix the second arms 413 to it.

Each second arm 4B includes an inner portion, a middle portion and an outer portion. The inner and outer portions are parallel with each other and connected together by the middle portion, which is perpendicular to them. The inner and outer portions support the adjacent ends of the eccentric link shaft 6 and piston rod 7, respectively. The second arms 4B have an arm length LB, which makes it possible to fit the piston rod 7 longer than the eccentric link shaft 6. This enables the piston rod 7 to be longer than the eccentric link shaft 6 and tilt tube 21.

The hydraulic cylinder 8 may be an oil cylinder. The hydraulic cylinder 8 houses a piston (not shown), which is fixed to the piston rod 7. The hydraulic cylinder 8 is fitted with a pair of pipe joints 8*a* and 8*b* at both ends. Pressure oil is supplied to the hydraulic cylinder 8 and discharged from it through the pipe joints 8*a* and 8*b* to slide the cylinder along the piston rod 7.

The connecting plate 9 is bolted to the hydraulic cylinder 8. The steering lever 10 can pivot on a bolt 10a fixed to the connecting plate 9. Alternatively, the steering lever 10 might be connected directly to the hydraulic cylinder 8.

The steering lever 10 connects the hydraulic cylinder 8 and engine 1 together so that, when the cylinder 8 slides, the engine 1 turns right and left to steer the boat. If the steering angle of the boat hull needs to be set to the maximum on both sides, it is essential that the hydraulic cylinder 8 should slide within equal ranges on both sides. Specifically, it is necessary that, when the engine 1 is oriented on the centerline of the boat (at the steering angle of 0 degree), the hydraulic cylinder 8 be positioned in the middle of the piston rod 7.

By using an end fitting 40 and considering the width "t" of its spacer 48, the arm length LB of the second arms 4B and the effective length LA of the piston rod 7, it is possible to position the hydraulic cylinder 8 in the middle of the rod 7, and it is possible for the cylinder stroke to be such that the engine 1 can turn over the maximum angle θ, which may be 35 degrees, on each side.

In other words, the hydraulic cylinder 8, which has a whole length 8L, slides equally in opposite directions along the effective length LA of the piston rod 7 so that the engine 1 turns over the steering angle θ on each side.

The arms 4A and 4B of each linking means 4 are linked together pivotably with respect to each other on the eccentric link shaft 6. Accordingly, the two linking means 4 absorb the variation in the relative position between the steering lever 10 and hydraulic cylinder 8 so that the engine 1 can be tilt at any steering angle.

FIGS. 3*b*, 4*a* and 4*b* show a linking means 4C which may replace each of the linking means 4. The linking means 4C has a cylindrical body 4Ca and an arm 4Cb. The cylindrical body 4Ca has a cylindrical cavity 4Cd, in which a bush 6Aa is fitted. The cylindrical body 4Ca supports an eccentric cam 6A, which can turn inside the bush 6Aa. One end of the eccentric link shaft 6 is supported by the eccentric cam 6A. The eccentric link shaft 6 extends through the center of the eccentric cam 6A. The supporting rod 6B is connecting to the eccentric link shaft 6. And the rod 6B is fitted to the center of the eccentric cam 6A and also fitted to the cylindrical body 4Ca with bearing means 6C. So the eccentric link shaft 6 and the rod 6B are rotatable against the linking means 4C. The adjacent end of the tilt tube 21 is supported rotatably by the eccentric cam 6A with bearing means 34A and spaced radially from the eccentric link shaft 6. The adjacent end of the piston rod 7 is supported by the arm 4Cb.

So the eccentric link shaft 6 and the tilt tube 21 are individually rotatable. And the piston rod 7 is rotatable around the eccentric link shaft 6.

The eccentric link shaft 6 is positioned on the axis of the eccentric cam 6A. The tilt tube 21 is positioned at the radial distance L1 from the link shaft 6. The piston rod 7 is positioned at the radial distance L2 from the eccentric link shaft 6. Accordingly, the linkage of the link shaft 6, piston rod 7 and tilt tube 21 through the linking means 4C is equivalent to that through the linking means 4.

The arm 4Cb is spaced by a distance LC axially of the cylindrical body 4Ca from the eccentric cam 6A, through which the eccentric link shaft 6 and tilt tube 21 extend. The arm 4Cb has a hole 4Cc cut through it near its outer end. The piston rod 7 extends through the arm hole 4Cc. Accordingly, the piston rod 7 can be longer than the link shaft 6. The distance LC, which is equivalent to the arm length LB of the second arms 4B of the linking means 4, may be equal to or longer than a length which allows for the necessary cylinder stroke.

The eccentric link shaft 6 and tilt tube 21 extend through the eccentric cams 6A of the linking means 4C. The phase between the tilt tube 21 and piston rod 7 can be displaced through the eccentric link shaft 6. Accordingly, the linking means 4C absorb the variation in the relative position between the steering lever 10 and hydraulic cylinder 8 so that the engine 1 can tilt at any steering angle.

As described hereinbefore, a steering apparatus for an outboard marine engine according to the present invention, which includes a hydraulic cylinder, can be fitted to any type of bracket on a boat hull, tilt to the maximum without interfering with the bracket and steer the boat to the limit equally on both sides.

What is claimed is:

1. A steering apparatus supported by a bracket fixed to the stern of a hull on which an outboard marine engine is mounted, the apparatus being capable of turning the engine to the limit in opposite directions on a substantially vertical axis, the apparatus being capable of tilting on a substantially horizontal tilt axis, the apparatus comprising:

a tilt tube extending along the tilt axis and supported by the bracket;

first and second linking means supported by both ends of the tilt tube pivotably around the tube;

a piston rod supported at both ends thereof by the linking means;

a steering hydraulic cylinder supported by the piston rod slidably along the rod; and an eccentric link shaft supported at both ends thereof by the linking means and positioned between the tilt tube and the piston rod;

the eccentric link shaft being higher than the tilt tube;

wherein the distance between the tilt tube and the piston rod is shorter than the sum of the distance between the tilt tube and the eccentric link shaft and the distance between the link shaft and the piston rod.

2. A steering apparatus according to claim 1, wherein the piston rod is longer than the eccentric link shaft, and wherein each of the linking means includes:

a first arm linking the tilt tube and the eccentric link shaft together; and a second arm linking the eccentric link shaft and the piston rod together;

the second arm supporting the adjacent ends of the eccentric link shaft and the piston rod at two points spaced axially from each other, the second arm having an arm length enabling the second arm to support the longer piston rod;

the two arms being connected together pivotably with respect to each other around the link shaft.

3. A steering apparatus according to claim 1, wherein each of the linking means includes:

a body having a cylindrical cavity formed therein;

an arm spaced from the body axially of the cylindrical cavity and supporting the adjacent end of the piston rod;

a bush fitted in the cylindrical cavity; and an eccentric cam supported rotatably inside the bush;

the eccentric link shaft extending through the center of the eccentric cam; the tilt tube extending rotatably through the eccentric cam and spaced from the eccentric link shaft.

4. A steering apparatus according to claim 1, wherein at least the first linking means has a hole cut therethrough near one end thereof, the apparatus further comprising an end fitting including:

a substantially cylindrical body integrally including a front portion, a flange and a barrel, the front portion being adapted to be inserted loosely into the tilt tube when the first linking means is fitted to the tube, the front portion having a conical surface converging forward, the flange being formed between the front portion and the barrel, the flange being adapted to contact with an end face of the tilt tube, the barrel extending through the hole of the first linking means, the cylindrical body having a thread cut thereinside;

a threaded rod extending through the cylindrical body and engaging with the thread of the cylindrical body, the threaded rod being adapted to engage at the rear end thereof with a rotating tool;

a taper sleeve fixed to the front end of the threaded rod and adapted to be inserted loosely into the tilt tube, the taper sleeve having a conical surface converging backward;

a first ring spring surrounding the conical surface of the cylindrical body; a second ring spring surrounding the conical surface of the taper sleeve; a cylindrical sleeve interposed between the two ring springs; and a nut engaging with the rear end of the threaded rod so as to fix the first linking means between the nut and the flange.

5. A steering apparatus according to claim 4, wherein the nut is resinous, the apparatus further comprising a washer interposed between the nut and the first linking means.

6. A steering apparatus according to claim 2, wherein at least the first linking means has a hole cut therethrough near one end thereof, the apparatus further comprising an end fitting including:

a substantially cylindrical body integrally including a front portion, a flange and a barrel, the front portion being adapted to be inserted loosely into the tilt tube when the first linking means is fitted to the tube, the front portion having a conical surface converging forward, the flange being formed between the front portion and the barrel, the flange being adapted to contact with an end face of the tilt tube, the barrel extending through the hole of the first linking means, the cylindrical body having a thread cut thereinside;

a threaded rod extending through the cylindrical body and engaging with the thread of the cylindrical body, the threaded rod being adapted to engage at the rear end thereof with a rotating tool;

a taper sleeve fixed to the front end of the threaded rod and adapted to be inserted loosely into the tilt tube, the taper sleeve having a conical surface converging backward;

a first ring spring surrounding the conical surface of the cylindrical body; a second ring spring surrounding the conical surface of the taper sleeve; a cylindrical sleeve interposed between the two ring springs; and a nut engaging with the rear end of the threaded rod so as to fix the first linking means between the nut and the flange.

7. A steering apparatus according to claim 3, wherein at least the first linking means has a hole cut therethrough near one end thereof, the apparatus further comprising an end fitting including:

a substantially cylindrical body integrally including a front portion, a flange and a barrel, the front portion being adapted to be inserted loosely into the tilt tube when the first linking means is fitted to the tube, the front portion having a conical surface converging forward, the flange being formed between the front portion and the barrel, the flange being adapted to contact with an end face of the tilt tube, the barrel extending through the hole of the first linking means, the cylindrical body having a thread cut thereinside;

a threaded rod extending through the cylindrical body and engaging with the thread of the cylindrical body, the threaded rod being adapted to engage at the rear end thereof with a rotating tool;

a taper sleeve fixed to the front end of the threaded rod and adapted to be inserted loosely into the tilt tube, the taper sleeve having a conical surface converging backward;

a first ring spring surrounding the conical surface of the cylindrical body; a second ring spring surrounding the conical surface of the taper sleeve; a cylindrical sleeve interposed between the two ring springs; and a nut engaging with the rear end of the threaded rod so as to fix the first linking means between the nut and the flange.

* * * * *